US010533741B2

(12) United States Patent
Taylor et al.

(10) Patent No.: US 10,533,741 B2
(45) **Date of Patent: *Jan. 14, 2020**

(54) LOW NOX BURNER WITH EXHAUST GAS RECYCLE AND PARTIAL PREMIX

(71) Applicant: Honeywell International Inc., Morristown, NJ (US)

(72) Inventors: Curtis L. Taylor, Fishers, IN (US); Bradley D. Patterson, Dunkirk, IN (US); William R. Berkenbush, Muncie, IN (US)

(73) Assignee: Honeywell International Inc., Morris Plains, NJ (US)

( * ) Notice: Subject to any disclaimer, the term of this patent is extended or adjusted under 35 U.S.C. 154(b) by 216 days.

This patent is subject to a terminal disclaimer.

(21) Appl. No.: 15/849,342

(22) Filed: Dec. 20, 2017

(65) Prior Publication Data

US 2019/0186732 A1 Jun. 20, 2019

(51) Int. Cl.

| | |
|---|---|
| ***F23C 7/06*** | (2006.01) |
| ***F23D 14/64*** | (2006.01) |
| ***F23C 9/06*** | (2006.01) |
| ***F23C 6/04*** | (2006.01) |
| ***F23C 3/00*** | (2006.01) |
| ***F23D 14/02*** | (2006.01) |

(52) U.S. Cl.

CPC ..... *F23C 6/042* (2013.01); *F23C 3/002* (2013.01); *F23C 7/06* (2013.01); *F23C 9/06* (2013.01); *F23D 14/02* (2013.01); *F23D 14/64* (2013.01); *F23C 2201/101* (2013.01); *F23C 2201/20* (2013.01); *F23C 2202/30* (2013.01); *F23C 2900/09002* (2013.01)

(58) Field of Classification Search

CPC ..... F23C 9/06; F23C 7/06; F23D 14/64; F23J 15/00; F27J 15/00

USPC ..... 431/244

See application file for complete search history.

(56) References Cited

U.S. PATENT DOCUMENTS 3,927,958 A * 12/1975 Quinn ..... F02C 3/34 431/116
3,994,665 A * 11/1976 Young ..... F23C 9/00 431/116

(Continued)

FOREIGN PATENT DOCUMENTS

EP 2500645 A1 9/2012
KR 20010009896 A * 2/2001 ..... F23G 7/06

*Primary Examiner* — Gregory L Huson
*Assistant Examiner* — Nikhil P Mashruwala

(57) ABSTRACT

The pre-mix burner assembly includes a jet pump comprising a suction chamber, a flue gas inlet, and a combustion air tube with a combustion air nozzle. The combustion air inlet includes a combustion air tube with a tapered nozzle, and it is connected to a combustion air fan. The flue gas inlet is connected to the suction chamber and the combustion air fan. The suction chamber surrounds the combustion air tube, and it has a jet pump nozzle with a discharge. The assembly includes a fuel gas inlet connected to the combustion air tube. The combustion air and fuel gas mixture exits the combustion air nozzle creating a negative pressure in the suction chamber and drawing flue gas into the suction chamber. The assembly includes a mixing tube positioned downstream of the jet pump discharge, and a burner block connected to an outlet of the mixing tube.

18 Claims, 4 Drawing Sheets

(56) References Cited

U.S. PATENT DOCUMENTS

| | | | | | |
|---|---|---|---|---|---|
| 4,130,388 | A * | 12/1978 | Flanagan | F23C 7/02 431/10 |
| 4,629,413 | A | 12/1986 | Michelson et al. | |
| 4,800,866 | A | 1/1989 | Finke | |
| 5,269,679 | A * | 12/1993 | Syska | F23C 6/045 431/115 |
| 5,413,477 | A | 5/1995 | Moreland | |
| 6,190,159 | B1 | 2/2001 | Moore et al. | |
| 8,454,349 | B2 * | 6/2013 | Stephens | F23C 6/045 110/204 |
| 9,416,966 | B2 * | 8/2016 | Lang | F23C 9/00 |
| 9,982,885 | B2 * | 5/2018 | Taylor | F23C 9/06 |
| 9,995,483 | B2 * | 6/2018 | Taylor | F23C 9/00 |
| 2016/0370002 | A1 | 12/2016 | Taylor et al. | |
| 2019/0186731 | A1 * | 6/2019 | Taylor | F23C 9/06 |
| 2019/0257274 | A1 * | 8/2019 | Hampson | F02D 9/02 |

* cited by examiner

LOW NOX BURNER WITH EXHAUST GAS RECYCLE AND PARTIAL PREMIX

The present disclosure relates to devices, methods, and systems utilizing a pre-mix burner with a combustion air driven jet pump.

BACKGROUND

Oxides of nitrogen in the form of Nitrogen Oxide (i.e., NO) and Nitrogen Dioxide ($NO_2$) (oxides of nitrogen can generally be referred to as: NOx) are generated by the burning of fossil fuels. Along with NOx from vehicles, NOx from fossil fuel fired industrial and commercial heating equipment (e.g., furnaces, ovens, etc.) is a major contributor to poor air quality and smog.

Flue gas recycling is an industry accepted way to achieve low NOx emissions in fossil fuel fired combustion applications. Numerous field and laboratory studies have proven the beneficial effect of recycling flue gas using a variety of fossil fuel burner-sealed fired chamber test arrangements. However, the addition of flue gas recycling to any fired application requires increased equipment complexity, capital, and/or operational expense.

One method to achieve flue gas recycling using premixed burners (using a combustion air and fuel gas mixture), is to have the flue gas ducted back to a point near the combustion air intake where it can enter the combustion air fan to be mixed with the combustion air and fuel gas. This method requires additional piping and assembly around the burner and boiler (or other sealed fired chamber).

It also requires an enlargement or upsizing of the combustion air fan to handle the increased volume of the added flue gas. Larger fans have increased cost and use more electricity per unit of heat produced. Further, these fans can become fouled due to the hot, corrosive flue gas and require the use of higher cost alloy materials, and/or additional cleaning and maintenance to keep the fan operational.

Another method, applicable to non-premixed burners, is to use an auxiliary fan to suction flue gas from the exhaust stack or fired chamber, and discharge that flue gas into the burner housing where it mixes with the incoming combustion air provided by the combustion air fan. This method requires additional flue gas piping and an additional corrosion resistant, high temperature rated fan to transport the hot flue gas.

Therefore, there is a need for a method of exhaust gas recycle in fuel fired equipment that reduces the complexity of the system. It would be desirable if the method also lowered the capital and operating costs, providing an economical process.

DETAILED DESCRIPTION

Figure 1:
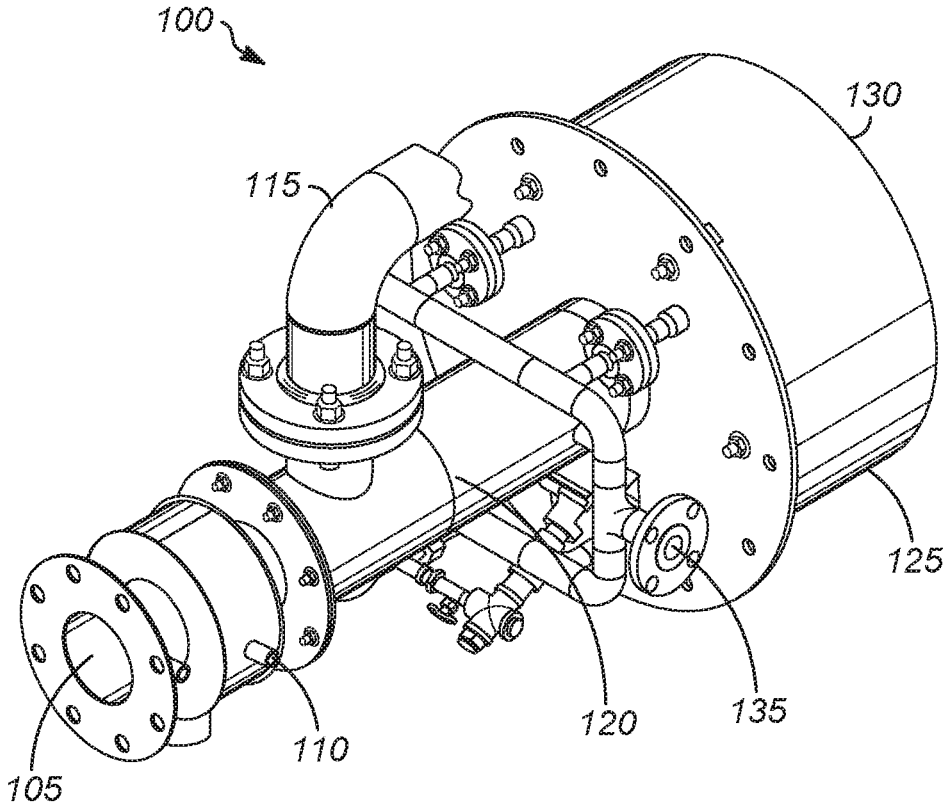
FIG. 1 is an angled overhead view of a burner with a combustion air driven jet pump according to one or more embodiments of the present disclosure.

Apparatuses, methods, and systems for utilizing a pre-mix burner with a combustion air driven jet pump are described herein. One pre-mix burner assembly includes a jet pump which includes a combustion air tube with a combustion air nozzle, a flue gas inlet, and a suction chamber. The combustion air nozzle outlet has a smaller diameter than the combustion air tube. In this manner, combustion air is moved from a larger volume area into a smaller volume area, thereby speeding the flow of the air toward the outlet of the jet pump.

The combustion air inlet is connected to a combustion air fan. The combustion air fan provides a volume of combustion air and combustion air pressure sufficient to drive the jet pump. This arrangement provides a negative pressure to pull flue gas from the flue gas inlet to be mixed with a combustion air and fuel gas mixture. It allows introduction of flue gas without having to increase piping or provide additional or upgrade fan components to either the flue gas path or the combustion air path as will be discussed in more detail below.

In some embodiments, the jet pump nozzle is also tapered so that the jet pump discharge has a smaller diameter than the diameter of the suction chamber. This structure can also aid in creating negative pressure.

In one aspect, the invention relates to a pre-mix burner assembly. In one embodiment, the pre-mix burner assembly includes a jet pump comprising a combustion air tube, a flue gas inlet, and a suction chamber. The combustion air tube receives combustion air and has a combustion air inlet at one end and a combustion air nozzle at the opposite end. The combustion air nozzle tapers to an outlet, which has a smaller diameter than the diameter of the combustion air tube. The combustion air inlet receives combustion air, and it is connected to a combustion air fan. The flue gas inlet is connected to the suction chamber and a source of flue gas. The suction chamber surrounds the combustion air tube and the combustion air nozzle, and it has a jet pump nozzle with a jet pump discharge. The pre-mix burner assembly includes a fuel gas inlet connected to the combustion air tube to allow fuel gas to mix with the combustion air in the combustion air tube to form a combustion air and fuel gas mixture. The combustion air and fuel gas mixture exits the combustion air nozzle creating a negative pressure in the suction chamber and drawing flue gas from the flue gas inlet into the suction chamber. The pre-mix burner assembly includes a burner housing positioned downstream of the jet pump discharge to receive a mixture of combustion air, fuel gas, and flue gas, and a burner block connected to an outlet of the burner block.

In some embodiments, the burner assembly can include a flame stabilizer at the outlet of the burner housing.

In some embodiments, the burner assembly can include a secondary fuel gas inlet connected to a manifold. The manifold can have at least one riser extending through an opening in the burner block to a secondary fuel gas tip providing fuel gas to a secondary flame zone.

In some embodiments, the combustion air nozzle outlet has a diameter d and the burner housing has a diameter D, and the ratio of the diameter d to the diameter D is between 0.2 and 0.9.

In some embodiments, the distance from the combustion air nozzle outlet to the inlet of the mixing tube is 0.8d to 2.0d.

In some embodiments, the burner assembly can include a mixing tube positioned in the mixing tube.

In some embodiments, the jet pump nozzle is tapered, and the jet pump nozzle discharge has a smaller diameter than the diameter of the suction chamber.

In some embodiments, the fuel gas inlet includes a manifold surrounding the combustion air tube, and there is at least one fuel gas inlet through a wall of the combustion air tube connecting the manifold to the inside of the combustion air tube. In various embodiments, multiple fuel inlets can be arranged around the circumference of the combustion air tube. This can allow for better mixing of the fuel with the combustion air. This can be especially true at the edges of the combustion air tube where an injector nearer to the central elongate axis of the combustion air tube may not be able to mix the fuel as well. The inlets can be arranged generally uniformly spaced from each other. This can also allow for better mixing of the fuel with the combustion air.

In some embodiments, the combustion air tube, the suction chamber, and the burner housing are arranged in a straight line.

In some embodiments, the combustion air tube and the suction pump are arranged at an angle to the burner housing. This arrangement reduces the footprint of the burner assembly, which can be useful in modifying existing burners.

In some embodiments, the jet pump discharge is connected to the burner housing at a position near the middle of the burner housing. A mixing tube is positioned in the burner housing, and it extends away from the outlet of the burner housing to a position beyond where the jet pump discharge is connected to the burner housing. The mixing tube has an open end opposite the outlet of the burner housing.

Figure 2:
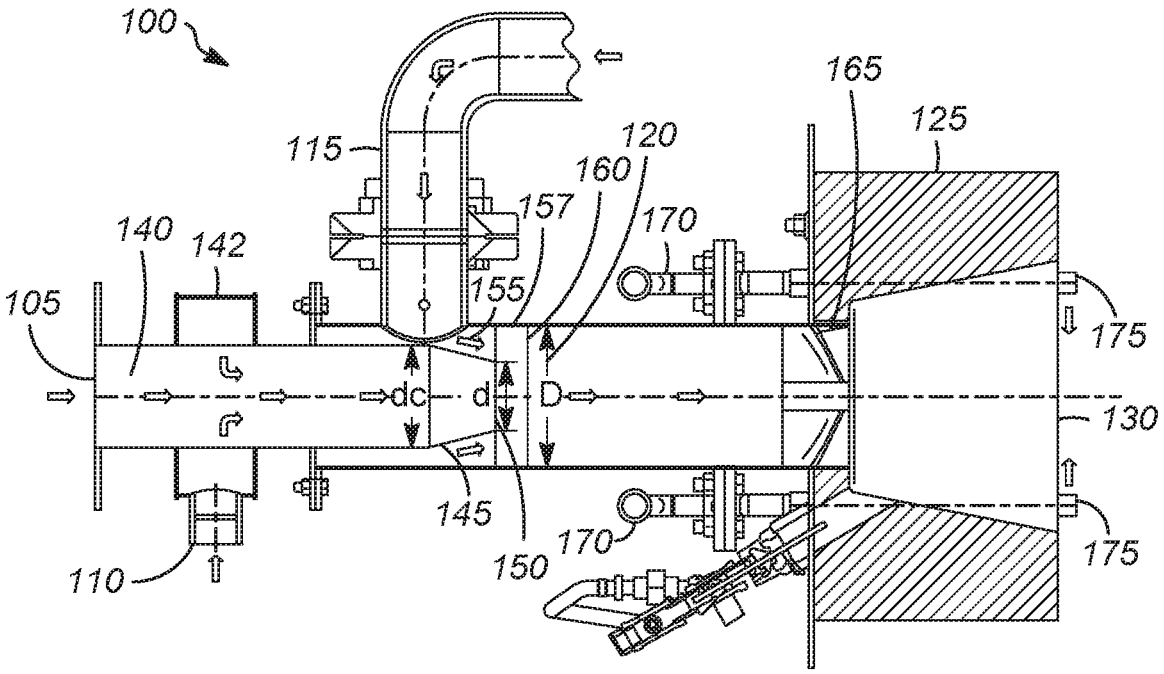
FIG. 2 is a cutaway side view of a burner with a combustion air driven jet pump according to one or more embodiments of the present disclosure.

FIGS. 1 and 2 illustrate one embodiment of a pre-mix burner assembly 100. FIG. 1 is an angled overhead view of a pre-mix burner assembly 100 with a combustion air driven jet pump according to one or more embodiments of the present disclosure. FIG. 2 is a cutaway side view of a pre-mix burner assembly of FIG. 1.

In the embodiment of FIGS. 1 and 2, the pre-mix burner assembly 100 includes a combustion air inlet 105. Combustion air is air received from outside the pre-mix burner assembly 100 into the combustion air inlet 105 for use in the combustion process (e.g., ambient air). Fuel gas is added to the combustion air via fuel gas inlet 110, and they are mixed to form a combustion air and fuel gas mixture. Flue gas enters through flue gas inlet 115 and mixes with the combustion air and fuel gas mixture forming a combustion air/fuel gas/flue gas mixture in a burner housing 120. The combustion air/fuel gas/flue gas mixture is ignited in the burner block 125, and the flame and resultant flue gas exits at burner outlet 130. There can optionally be a secondary fuel gas inlet 135, if desired.

The embodiments of the present disclosure can be constructed from any suitable material. Suitable materials include, but are not limited to, rolled and formed sheet metal, tubing, and/or pipe.

FIG. 2 illustrates the interior of pre-mix burner assembly 100. The pre-mix burner assembly 100 includes the combustion air inlet 105. The combustion air inlet 105 comprises a combustion air tube 140, and a combustion air nozzle 145. Combustion air is air received from outside the assembly into the combustion air tube 140 for use in the combustion process (e.g., ambient air). The combustion air inlet 105 is connected to a combustion air fan (not shown) provided upstream of the combustion air inlet 105. The combustion air fan provides a volume of combustion air and combustion air pressure sufficient to drive the jet pump.

The combustion air nozzle 145 tapers to a combustion air nozzle outlet 150, which has a smaller diameter (d) than the diameter (dc) of the combustion air tube 140. As used herein, the term diameter can be a diameter of a fluid path having circular cross section or can be a measurement of a largest width of a fluid path having a non-circular cross section (e.g., oval, rectangular). As illustrated in FIG. 2, the combustion air nozzle 145 is frustoconical.

Fuel gas is added into the combustion air tube 140 through fuel gas inlet 110 which is connected to the combustion air tube 140. The fuel gas can be added through one or more fuel inlets, such as fuel jets or fuel ports (not shown). For example, in some embodiments, the fuel gas inlet 110 includes a manifold 142 surrounding the combustion air tube 140 radially and one or more fuel inlets (not shown). The wall of the combustion air tube 140 (and the inside wall of the manifold 142, if present), can, for example, include a series of holes drilled radially and inward at an angle ranging from 0-90 degrees and directed downstream toward the combustion air nozzle 145. In this way, the fuel can be dispersed and mixed with the combustion air in the combustion air tube 140 to form a combustion air and fuel gas mixture.

The combustion air and fuel gas mixture enters the combustion air nozzle 145, accelerates and ejects into the suction chamber 155, creating a negative pressure condition in the suction chamber 155 when the combustion air fan is operating. The suction chamber 155 is connected to the flue gas inlet 115. The flue gas inlet 115 is also connected to a source of flue gas, such as a furnace chamber or other flue gas source. The negative pressure in the suction chamber 155 draws flue gas from the flue gas source through the flue gas inlet into the suction chamber 155.

As shown, the suction chamber 155 and the jet pump nozzle 157 have a constant diameter. However, in some embodiments, the jet pump nozzle 157 can be tapered.

The combustion air and fuel gas mixture and the flue gas exit the jet pump nozzle 157 through jet pump discharge 160. The jet pump nozzle discharge 160 is connected to the burner housing 120 which extends downstream to the burner block 125. The combustion air and fuel gas mixture and the flue gas pass to the burner housing 120 where they are mixed to form a combustion air/fuel gas/flue gas mixture. The burner housing 120 has a diameter (D).

The combustion air/fuel gas/flue gas mixture is carried downstream to the burner block 125, where the mixture is ignited in the burner block 125 by a pilot or other ignition means. The flame and resultant flue gas exit at outlet 130.

The flame can be stabilized indefinitely by various flame stabilization methods known to people of skill in the art. In some embodiments, there can be a flame stabilizer 165 at the outlet of the burner housing 120. Suitable flame stabilizers include, but are not limited to, swirlers, bluff bodies, and mixing cones.

In embodiments with a secondary fuel gas inlet 135 (shown in FIG. 1), there can be a manifold 170 with one or more risers that extend through openings in the burner block 125 to secondary fuel gas tips 175 in the burner block 125 to provide fuel gas to the secondary flame zone.

In one example embodiment, the combustion air nozzle 150 with diameter (d) and the jet pump discharge 160 with diameter (D) are sized and located according to the following ratios:

1) Combustion air nozzle diameter to jet pump discharge diameter=$0.2<d/D<0.9$

2) Distance from combustion air nozzle exit to burner housing entrance=$0.8d-2.0d$ As shown in FIGS. 1 and 2, the combustion air tube, the jet pump, and the burner housing are arranged in a line.

Figure 3:
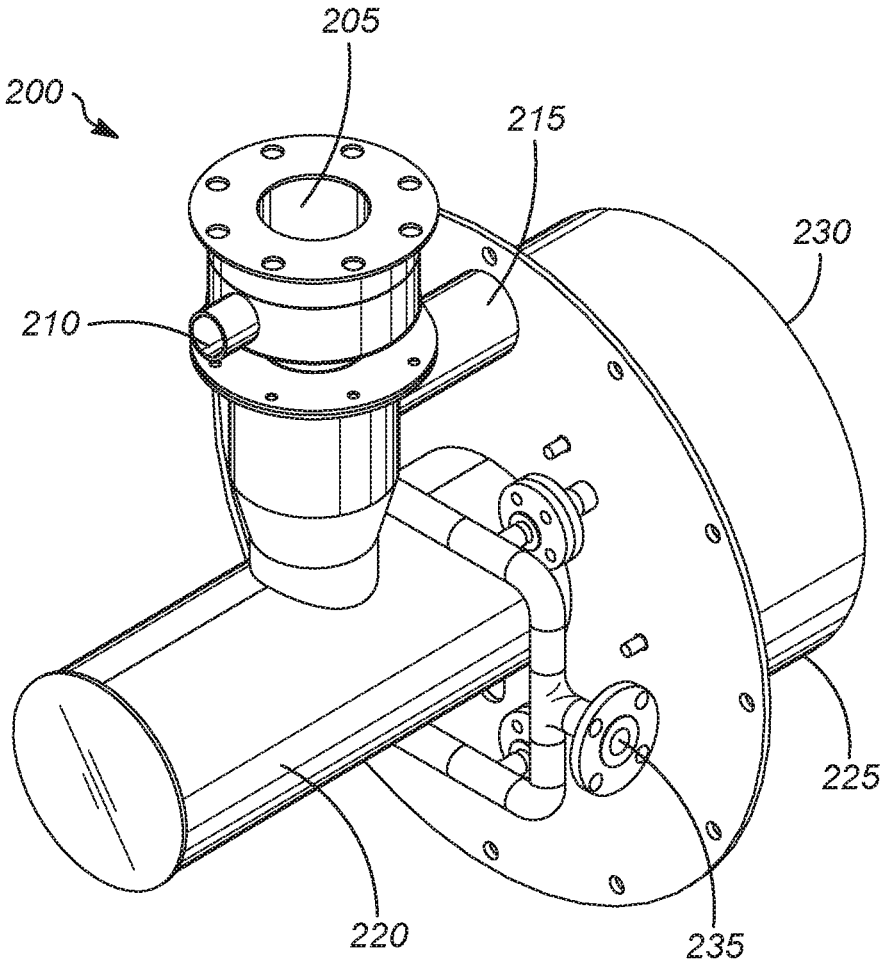
FIG. 3 is an angled overhead view of a burner with a combustion air driven jet pump according to one or more embodiments of the present disclosure.
Figure 4:
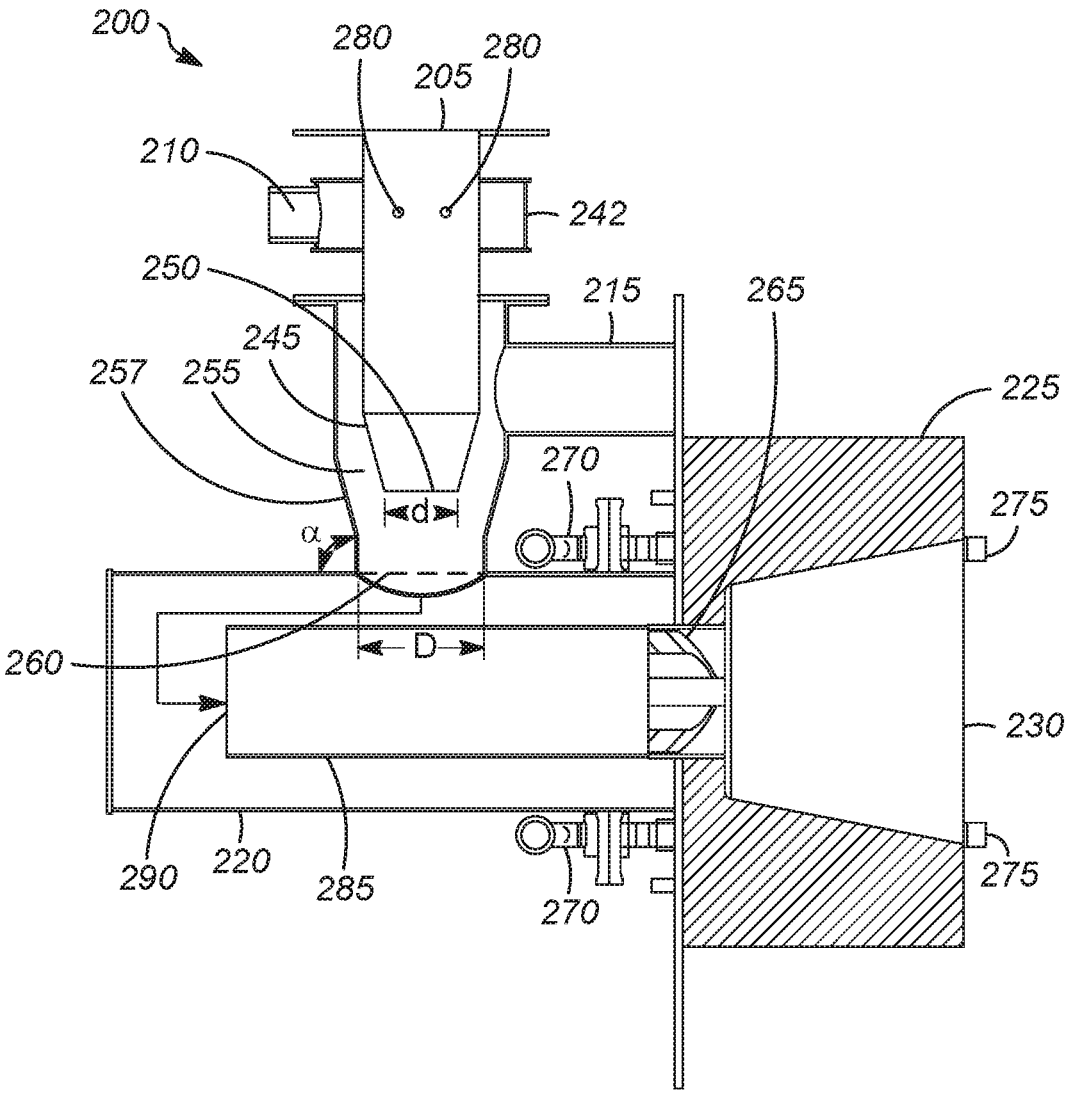
FIG. 4 is a cutaway side view of a burner with a combustion air driven jet pump according to one or more embodiments of the present disclosure.

FIGS. 3 and 4 illustrate an embodiment in which the combustion air tube and the jet pump form an angle α with respect to the burner housing. This arrangement reduces the amount of space the burner assembly requires, making it advantageous for use with existing burners.

The pre-mix burner assembly 200 includes the combustion air inlet 205. The combustion air inlet 205 comprises a combustion air tube 240, and a combustion air nozzle 245. The combustion air inlet 205 is connected to a combustion air fan (not shown) provided upstream of the combustion air inlet 205.

The combustion air nozzle 245 tapers to a combustion air nozzle outlet 250, which has a smaller diameter (d) than the diameter (dc) of the combustion air tube 240. As discussed above, the diameter can be a diameter of a fluid path having circular cross section, or it can be a measurement of a largest width of a fluid path having a non-circular cross section.

Fuel gas is added into the combustion air tube 240 through fuel gas inlet 210 which is connected to the combustion air tube 240. In this embodiment, the fuel gas inlet 210 includes a manifold 242 surrounding the combustion air tube 240 radially and one or more fuel inlets 280. The fuel gas flows through the fuel inlets 280 into the combustion air tube 240 where it mixes with the combustion air.

The combustion air and fuel gas mixture enters the combustion air nozzle 245, accelerates and ejects into the center of the suction chamber 255, creating negative pressure in the suction chamber 255 when the combustion air fan is operating. The flue gas inlet is also connected to a source of flue gas, such as a furnace chamber or other flue gas source. The negative pressure draws flue gas from the flue gas source into the suction chamber 255 via the flue gas inlet 215. As shown, jet pump nozzle 257 is tapered, and the jet pump discharge 260 has a diameter less than the diameter of the suction chamber 255. Alternatively, as discussed above, the suction chamber 255 and the jet pump nozzle 257 can have a constant diameter.

The combustion air and fuel gas mixture and the flue gas exit the jet pump nozzle 257 through jet pump discharge 260.

The combustion air tube 240 and suction chamber 255 form an angle α with the burner housing 220. The angle α typically ranges from about 5° to about 175°, or about 30° to about 150°, or about 60° to about 120°, or about 75° to about 105°.

The jet pump discharge 260 is connected to the inlet of the burner housing 220 at a position near the middle of the burner housing 220, e.g., between about 25 and 75% of the length of the burner housing 220. There is a mixing tube 285 positioned in the burner housing 220. The mixing tube 285 is surrounded by the burner housing 220. The mixing tube 285 extends away from the outlet of the burner housing 220 beyond the position where the jet pump discharge 260 is connected to the burner housing 220. When the combustion air and fuel gas mixture and the flue gas enters the burner housing 220, the presence of the mixing tube 285 forces the gases around the end of the mixing tube 285 and into the inlet 290 of the mixing tube 285. The combustion air and fuel gas mixture and the flue gas are mixed in the mixing tube 285 to form a combustion air/fuel gas/flue gas mixture.

The combustion air/fuel gas/flue gas mixture is lit by a pilot or other ignition means in the burner block 225. The flame and resultant flue gas exits at outlet 230.

In some embodiments, there can be a flame stabilizer 265 at the outlet of the burner housing 220. In embodiments with a secondary fuel gas inlet 235, there can be a manifold 270 with multiple riser that extend through openings in the burner block 225 to secondary fuel gas tips 275 in the burner block to provide fuel gas to the secondary flame zone.

In one example embodiment, the combustion air nozzle 250 with diameter (d) and the jet pump discharge 260 with diameter (D) are sized and located according to the following ratios:

1) Combustion air nozzle diameter to jet pump discharge diameter=$0.2<d/D<0.9$

2) Distance from combustion air nozzle exit to burner housing entrance=0.8d–2.0d As used herein, "a" or "a number of" something can refer to one or more such things. For example, "a number of resources" can refer to one or more resources. Additionally, the designator "N", as used herein, particularly with respect to reference numerals in the drawings, indicates that a number of the particular feature so designated can be included with a number of embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

Specific Embodiments

While the following is described in conjunction with specific embodiments, it will be understood that this description is intended to illustrate and not limit the scope of the preceding description and the appended claims.

A first embodiment of the invention is a pre-mix burner assembly comprising a jet pump comprising a combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube and the combustion air nozzle, the suction chamber having a jet pump nozzle with a jet pump discharge; a fuel gas inlet connected to the combustion air tube to allow fuel gas to mix with the combustion air in the combustion air tube to form a combustion air and fuel gas mixture, wherein the combustion air and fuel gas mixture exiting the combustion air nozzle creates a negative pressure in the suction chamber and draws flue gas from the flue gas inlet into the suction chamber, the suction chamber receiving the flue gas; a burner housing positioned downstream of the jet pump discharge to receive a mixture of combustion air, fuel gas, and flue gas; and a burner block connected to an outlet of the burner housing. An embodiment of the invention is one, any or all of prior embodiments in this paragraph up through the first embodiment in this paragraph further comprising a flame stabilizer at the outlet of the burner housing. An embodiment of the invention is one, any or all of prior embodiments in this paragraph up through the first embodiment in this paragraph further comprising a secondary fuel gas inlet connected to a manifold having at least one riser extending through an opening in the burner block to a secondary fuel gas tip providing fuel gas to a secondary flame zone. An embodiment of the invention is one, any or all of prior embodiments in this paragraph up through the first embodiment in this paragraph wherein the combustion air nozzle outlet has a diameter d and the jet pump discharge has a diameter D, and wherein a ratio of the diameter d to the diameter D is between 0.2 and 0.9. An embodiment of the invention is one, any or all of prior embodiments in this paragraph up through the first embodiment in this paragraph wherein a distance from the combustion air nozzle outlet to an inlet of the burner housing is 0.8d to 2.0d. An embodiment of the invention is one, any or all of prior embodiments in this paragraph up through the first embodiment in this paragraph further comprising a mixing tube positioned in the burner housing. An embodiment of the invention is one, any or all of prior embodiments in this paragraph up through the first embodiment in this paragraph wherein the jet pump nozzle is tapered, and the jet pump nozzle discharge has a smaller diameter than a diameter of the suction chamber. An embodiment of the invention is one, any or all of prior embodiments in this paragraph up through the first embodiment in this paragraph wherein the fuel gas inlet comprises a manifold surrounding the combustion air tube and wherein there is at least one fuel gas inlet through a wall of the combustion air tube connecting the manifold to the inside of the combustion air tube. An embodiment of the invention is one, any or all of prior embodiments in this paragraph up through the first embodiment in this paragraph wherein the combustion air tube, the suction chamber, and the burner housing are arranged in a straight line. An embodiment of the invention is one, any or all of prior embodiments in this paragraph up through the first embodiment in this paragraph wherein the combustion air tube and the suction chamber are arranged at an angle to the burner housing. An embodiment of the invention is one, any or all of prior embodiments in this paragraph up through the first embodiment in this paragraph wherein the jet pump discharge is connected to the burner housing at a position near the middle of the burner housing, and further comprising a mixing tube positioned in the burner housing and extending away from the outlet of the burner housing beyond the position where the jet pump discharge is connected to the burner housing, the mixing tube having an open end opposite the outlet of the burner housing.

A second embodiment of the invention is a pre-mix burner assembly comprising a jet pump comprising a combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube and the combustion air nozzle, the suction chamber having a jet pump nozzle with a jet pump discharge; a fuel gas inlet connected to the combustion air inlet to allow fuel gas to mix with the combustion air in the combustion air chamber to form a combustion air and fuel gas mixture, the fuel gas inlet comprising a manifold surrounding the combustion air tube and wherein there is at least one fuel gas inlet through a wall of the combustion air tube connecting the manifold to the inside of the combustion air tube, wherein the combustion air and fuel gas mixture exiting the combustion air nozzle creates a negative pressure in the suction chamber and draws flue gas from the flue gas inlet into the suction chamber, the suction chamber receiving the flue gas; a burner housing positioned downstream of the jet pump discharge to receive a mixture of combustion air, fuel gas, and flue gas; a flame stabilizer at an outlet of the burner housing; and a burner block connected to the outlet of the burner housing. An embodiment of the invention is one, any or all of prior embodiments in this paragraph up through the second embodiment in this paragraph further comprising a secondary fuel gas inlet connected to a manifold having at least one riser extending through an opening in the burner block to a secondary fuel gas tip providing fuel gas to a secondary flame zone. An embodiment of the invention is one, any or all of prior embodiments in this paragraph up through the second embodiment in this paragraph wherein the combustion air nozzle outlet has a diameter d and the burner housing has a diameter D, and wherein a ratio of the diameter d to the diameter D is between 0.2 and 0.9. An embodiment of the invention is one, any or all of prior embodiments in this paragraph up through the second embodiment in this paragraph wherein a distance from the combustion air nozzle outlet to an inlet of the burner housing is 0.8d to 2.0d. An embodiment of the invention is one, any or all of prior embodiments in this paragraph up through the second embodiment in this paragraph further comprising a mixing tube positioned in the burner housing. An embodiment of the invention is one, any or all of prior embodiments in this paragraph up through the second embodiment in this paragraph wherein the jet pump nozzle is tapered, and the jet pump nozzle discharge has a smaller diameter than a diameter of the suction chamber. An embodiment of the invention is one, any or all of prior embodiments in this paragraph up through the second embodiment in this paragraph wherein the combustion air tube and the suction chamber are arranged at an angle to the burner housing.

A third embodiment of the invention is a pre-mix burner assembly comprising a jet pump comprising a combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube and the combustion air nozzle, the suction chamber having a jet pump nozzle with a jet pump discharge; a fuel gas inlet connected to the combustion air inlet to allow fuel gas to mix with the combustion air in the combustion air chamber to form a combustion air and fuel gas mixture, the fuel gas inlet comprising a manifold surrounding the combustion air tube and wherein there is at least one fuel gas inlet through a wall of the combustion air tube connecting the manifold to the inside of the combustion air tube, wherein the combustion air and fuel gas mixture exiting the combustion air nozzle creates a negative pressure in the suction chamber and draws flue gas from the flue gas inlet into the suction chamber, the suction chamber receiving the flue gas; a burner housing positioned downstream of the jet pump discharge to receive a mixture of combustion air, fuel gas, and flue gas, wherein the jet pump discharge is connected to the burner housing at a position near the middle of the mixing tube; a mixing tube positioned in the burner housing and extending away from an outlet of the burner housing beyond the position where the jet pump discharge is connected to the burner housing, the mixing tube having an open end opposite the outlet of the burner housing, a flame stabilizer at the outlet of the mixing tube; and a burner block connected to the outlet of the mixing tube. 1

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A pre-mix burner assembly comprising:

a jet pump comprising a combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube and the combustion air nozzle, the suction chamber having a jet pump nozzle with a jet pump discharge;

a fuel gas inlet connected to the combustion air tube to allow fuel gas to mix with the combustion air in the combustion air tube to form a combustion air and fuel gas mixture, the fuel gas inlet comprising a manifold surrounding the combustion air tube and wherein there is at least one fuel gas inlet through a wall of the combustion air tube connecting the manifold to the inside of the combustion air tube, wherein the combustion air and fuel gas mixture exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive a mixture of combustion air, fuel gas, and flue gas; and a burner block connected to an outlet of the burner housing.

2. The burner assembly of claim 1 further comprising a flame stabilizer at the outlet of the burner housing.

3. The burner assembly of claim 1 further comprising a secondary fuel gas inlet connected to a manifold having at least one riser extending through an opening in the burner block to a secondary fuel gas tip providing fuel gas to a secondary flame zone.

4. The burner assembly of claim 1 wherein the combustion air nozzle outlet has a diameter d and the jet pump discharge has a diameter D, and wherein a ratio of the diameter d to the diameter D is between 0.2 and 0.9.

5. The burner assembly of claim 1 wherein the combustion air nozzle outlet has a diameter d and wherein a distance from the combustion air nozzle outlet to an inlet of the burner housing is 0.8d to 2.0d.

6. The burner assembly of claim 1 further comprising a mixing tube positioned in the burner housing.

7. The burner assembly of claim 1 wherein the jet pump nozzle is tapered, and the jet pump nozzle discharge has a smaller diameter than a diameter of the suction chamber.

8. The burner assembly of claim 1 wherein the combustion air tube, the suction chamber, and the burner housing are arranged in a straight line.

9. The burner assembly of claim 1 wherein the combustion air tube and the suction chamber are arranged at an angle to the burner housing.

10. The burner assembly of claim 9 wherein the jet pump discharge is connected to the burner housing at a position near the middle of the burner housing, and further comprising a mixing tube positioned in the burner housing and extending away from the outlet of the burner housing beyond the position where the jet pump discharge is connected to the burner housing, the mixing tube having an open end opposite the outlet of the burner housing.

11. A pre-mix burner assembly comprising:

a jet pump comprising a combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube and the combustion air nozzle, the suction chamber having a jet pump nozzle with a jet pump discharge;

a fuel gas inlet connected to the combustion air inlet to allow fuel gas to mix with the combustion air in the combustion air chamber to form a combustion air and fuel gas mixture, the fuel gas inlet comprising a manifold surrounding the combustion air tube and wherein there is at least one fuel gas inlet through a wall of the combustion air tube connecting the manifold to the inside of the combustion air tube, wherein the combustion air and fuel gas mixture exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive a mixture of combustion air, fuel gas, and flue gas;

a flame stabilizer at an outlet of the burner housing; and a burner block connected to the outlet of the burner housing.

12. The burner assembly of claim 11 further comprising a secondary fuel gas inlet connected to a manifold having at least one riser extending through an opening in the burner block to a secondary fuel gas tip providing fuel gas to a secondary flame zone.

13. The burner assembly of claim 11 wherein the combustion air nozzle outlet has a diameter d and the burner housing has a diameter D, and wherein a ratio of the diameter d to the diameter D is between 0.2 and 0.9.

14. The burner assembly of claim 11 wherein the combustion air nozzle outlet has a diameter d and wherein a distance from the combustion air nozzle outlet to an inlet of the burner housing is 0.8d to 2.0d.

15. The burner assembly of claim 11 further comprising a mixing tube positioned in the burner housing.

16. The burner assembly of claim 11 wherein the jet pump nozzle is tapered, and the jet pump nozzle discharge has a smaller diameter than a diameter of the suction chamber.

17. The burner assembly of claim 11 wherein the combustion air tube and the suction chamber are arranged at an angle to the burner housing.

18. A pre-mix burner assembly comprising:

a jet pump comprising a combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube and the combustion air nozzle, the suction chamber having a jet pump nozzle with a jet pump discharge;

a fuel gas inlet connected to the combustion air inlet to allow fuel gas to mix with the combustion air in the combustion air chamber to form a combustion air and fuel gas mixture, the fuel gas inlet comprising a manifold surrounding the combustion air tube and wherein there is at least one fuel gas inlet through a wall of the combustion air tube connecting the manifold to the inside of the combustion air tube, wherein the combustion air and fuel gas mixture exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive a mixture of combustion air, fuel gas, and flue gas, wherein the jet pump discharge is connected to the burner housing at a position near the middle of the mixing tube;

a mixing tube positioned in the burner housing and extending away from an outlet of the burner housing beyond the position where the jet pump discharge is connected to the burner housing, the mixing tube having an open end opposite the outlet of the burner housing, a flame stabilizer at the outlet of the mixing tube; and a burner block connected to the outlet of the mixing tube.

* * * * *